United States Patent [19]

Collgon

[11] Patent Number: 4,467,511

[45] Date of Patent: Aug. 28, 1984

[54] METHOD FOR THE CONFORMATION OF A METALLIC TUBE, PARTICULARLY FOR A HEAT EXCHANGER, AND A HEAT EXCHANGER PROVIDED WITH TUBES THUS CONFORMED

[76] Inventor: Pierre C. Collgon, 25, rue du Perche, 28400 Nogent le rotrou, France

[21] Appl. No.: 169,427

[22] Filed: Jul. 16, 1980

[30] Foreign Application Priority Data

Jul. 26, 1979 [FR] France ..... 79 19357

[51] Int. Cl.[3] ..... B21D 53/02

[52] U.S. Cl. ..... 29/157.3 C; 29/157.4; 72/367

[58] Field of Search ..... 29/527.4, 157.3 R, 157.3 A, 29/155 R, 155 C, 157.3 C, 157.4; 165/35, 38, 165/175; 228/183, 60; 113/1 C, 118 C; 72/369, 72/453.15, 367, 369, 370

[56] References Cited

U.S. PATENT DOCUMENTS

| | | | |
|---|---|---|---|
| 1,856,618 | 5/1932 | Brown | 29/157.4 |
| 2,367,942 | 1/1945 | Hartman | 72/370 |
| 3,426,409 | 2/1969 | Lewis | 228/183 |
| 3,710,473 | 1/1973 | McElwain et al. | 165/175 |
| 3,906,605 | 9/1975 | McLain | 29/157.3 R |
| 3,972,371 | 8/1976 | Plegat | 29/157.4 |
| 4,159,034 | 6/1979 | Bellovary et al. | 228/183 |

*Primary Examiner*—Howard N. Goldberg
*Assistant Examiner*—V. K. Rising

[57] ABSTRACT

A method for conforming to a circular cross-section the end of a metallic tube of oblong cross-section for a heat exchanger, comprising two steps, one during which the end of the tube is subjected to a radial compression, and the other during which a punch having a diameter equal to that desired for the inner surface of the tube end is forcibly driven into said end.

12 Claims, 18 Drawing Figures

METHOD FOR THE CONFORMATION OF A METALLIC TUBE, PARTICULARLY FOR A HEAT EXCHANGER, AND A HEAT EXCHANGER PROVIDED WITH TUBES THUS CONFORMED

The invention relates to a method for the conformation of a metallic tube, particularly for a heat exchanger, such as a radiator which is part of the cooling circuit of a vehicle engine, or an exchanger which is part of a heating and/or air-conditioning installation of the passenger space of the vehicle.

It applies more particularly to heat exchangers in which a heating or cooling liquid or fluid flows inside tubes provided with gills , fins or other heat exchange means with an air flow sweeping across the tubes, and the ends of which emerge, for allowing the flow of liquid or fluid, in at least one collecting chamber bounded by a "water box" and a collector formed by a hollowed plate through which tightly extend the tube ends.

In most heat exchangers of this type which are commonly used, the tubes have a circular cross-section and the holes of the plates are circular, thereby allowing an easy assembly of the tube ends with the hollowed plates.

It has already been proposed to use tubes of oblong cross-section so as to increase their surface area with the air sweeping across them without increasing the aerodynamic resistance of the exchanger, and - in order to allow the assembly of such tubes with plates formed with circular holes - to conform the ends of said tubes in order to change them from an oblong cross-section to a terminal circular cross-section.

This conformation of the ends of tubes having a body of oblong cross-section offers also advantages in other domains, for example when the tubes of oblong cross-section are intended for being connected to tubes of circular cross-section, as is the case for example in evaporators, and this by soldering or screwing.

But the methods and means used for such a conformation have not, hitherto, given satisfactory results; notably, they do not allow obtaining a tube end the edge and outer surface of which exhibit geometrical characteristic features sufficiently accurate for allowing a connection with another tube, or for ensuring the tightness of its assembly with a hollowed plate, in a manner as simple and efficient as when using tubes having a circular cross-section ower all their length.

The present invention remedies this disadvantage.

Its object is a method for the conformation of at least one end of a tube, in order to change it from an oblong cross-section to a circular cross-section, characterized in that it comprises two steps, one during which the end of the tube is subjected to a radial compression and the other during which a punch is forcibly driven into the end opening, its diameter being equal to that which is desired for the inner surface of the tube end, said operation being similar to an expansion operation.

It has been established that by operating in two phases, as defined hereabove, one obtains, with two simple operations, a tube the body of which retains the oblong cross-section which is desirable for the heat exchange, and the end of which has an outer surface having a circular shape sufficiently accurate for allowing an assembly with a plate formed with circular holes and, moreover, with a tightness just as good as when using a tube having a circular cross-section all over its length, and this even if the tube is subjected to stresses - such as those caused by the vibrations and pressure variations of a liquid - which could be detrimental for the tightness.

It has also been established that with this two step method, the intermediate portion of the tube which is between the oblong section and the end of the circular section could have a length reduced to a minimum value, of the order of 0.2 times the diameter of the end of circular section, thereby allowing making a heat exchanger in which the edge of a usual collector or hollowed plate is in immediate engagement with a thermal exchange gill, without it being necessary to foresee a cumbrous cross-piece, of no use for the thermal exchange, between the collector and the first gill.

In a preferred embodiment of the invention, the phase during which the tube end is subjected to a radial compression is effected first, said compression being directed along the main axis of the oblong section and bringing thus said end to a cross-section which is coming close to a circular cross-section.

It is also possible to proceed such that the operation similar to an expansion operation is effected first.

The results are all the more satisfactory that there is greater elongation of the mean perimeter of the cross-section of the tube during the phase which is similar to an expansion phase, but of course this elongation should not exceed the limit of elasticity of the constituant metal of the tube.

The invention has also for object a tube of oblong cross-section for a heat exchanger, wherein the ratio between the larger and the smaller dimensions of the tube is between 1.5 and 2.5.

It has been established that when this condition is complied with, one can optimize the heat exchange between the liquid flowing through the tubes and the air sweeping transversely across the tubes, parallel to the direction of the larger dimension of their cross-section.

Further characteristics of the invention will become more apparent from the description of some its embodiments, with reference to the accompanying drawings wherein :

FIG. 1 shows a tool for carrying out one phase of the method according to the invention;

FIG. 1*a* is a sectional view similar to FIG. 1, but for another condition of the cutting tool, along line I*a*—I*a* of FIG. 2;

Figure 1:
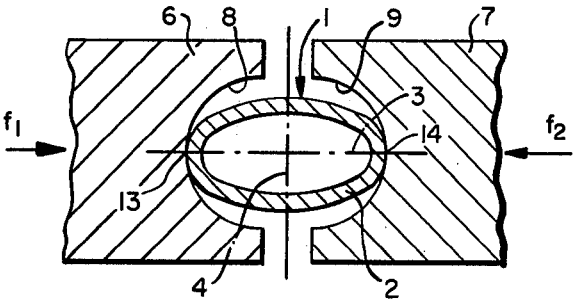

Starting from a tube 2 of oval cross-section 2 (FIG. 1), having a main axis 3 and a small axis 4 perpendicular to each other, on which are crimped gills $20_1$, $20_2$, etc. (FIGS. 6 and 7), one compresses the end of the tube with a two jaw tool 6, 7, having identical active surfaces in register, respectively 8 and 9, each of which is semi-cylindrical and of circular cross-section, the generating lines of said semi-cylindrical surfaces being parallel to the tube axis. The radius of each said semi-cylindrical surfaces is slightly superior to the radius of the outer surface which one desires to obtain for the end of the tube.

With a view to establishing a flared out connection of short length between the end 5 and the body 5*a* of the tube 1 which is to remain with an oval cross-section, the tools 6 and 7 are both formed with a chamfer or flare, respectively 10 and 11.

Figure 3:
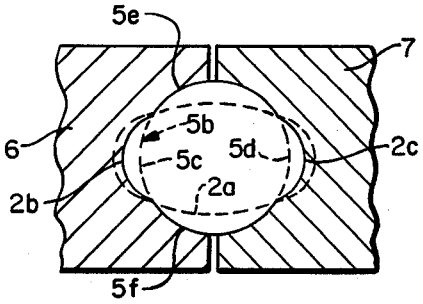
FIG. 3 is a sectional view along line III—III of FIG. 2.

Said chamfer or flare is conformed as follows (FIG. 3): the jaws 6 and 7 in the position where they are close to each other delimit above the chamfers 10 and 11 a cylinder of axis 12 (FIG. 1*a*), coincident with the tube axis. In projection on a plane perpendicular to said axis, one traces (FIG. 3) an oval 2*a* corresponding to the outer surface of the tube and the circle 5*b* corresponding to the surfaces 8 and 9; said circle 5*b* comprises two arcs 5*c* and 5*d* inside the oval 2*a*, and two arcs 5*e* and 5*f* outside the oval 2*a*. The arcs 5*e* and 5*f* correspond to the surfaces 8 and 9 over the whole length or height of the tool; on the contrary, on this projection, the chamfers correspond to arcs of a curve, such as 2*b* and 2*c*, comprised between the oval 2*a* and the circle 5*b*.

Figure 1A:
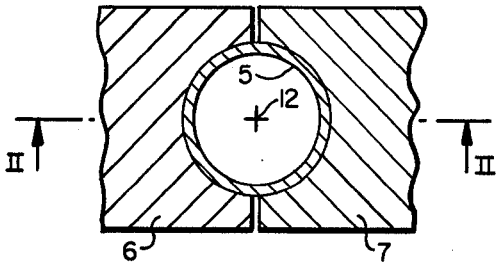

The jaws 6 and 7 are brought in engagement with the outer surface of the tube at the ends 13 and 14 (FIG. 1) of its main axis 3 and are brought close to each other parallel to said main axis according to arrows $f_1$ and $f_2$. The tube is thus narrowed parallel to axis 3 and is broadened in the perpendicular direction, and its cross-section, at the end of this first step of the method, has the general shape of a circular ring (FIG. 1*a*).

Figure 4:
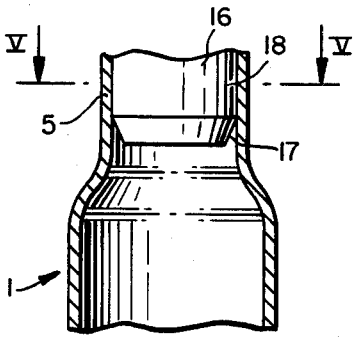
FIG. 4 shows the tool carrying out another phase of the method of the invention.

A punch 16 (FIG. 4), of circular cross-section, with a frustoconical end 17 and an active cylindrical portion 18 of circular cross-section, of diameter larger than that of the inner surface of the ring obtained at the end of the first step of the method, is then forcibly introduced inside the end 5 for providing it, by expansion, with a circular cylindrical shape, that is by increase of its perimeter.

Figure 5:
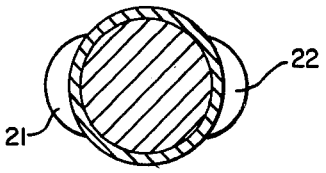
FIG. 5 is a sectional view along line V—V of FIG. 4.

The method is carried out so that the mean perimeter of the end 5 is, after this last step of the method, superior, preferably by at least 1%, to the mean perimeter of the oval cross-section. However, the method is carried out so that at any moment, the limit of elasticity of the constituant metal of the tube is not exceeded. It is also foreseen that the diameter of the outer surface of the end thus conformed is less than the length of the main axis of the outer surface of the oval section, so that shoulders 21 and 22 (FIGS. 5 and 7) are formed and act as abutments for the gill $20_1$.

Figure 2:
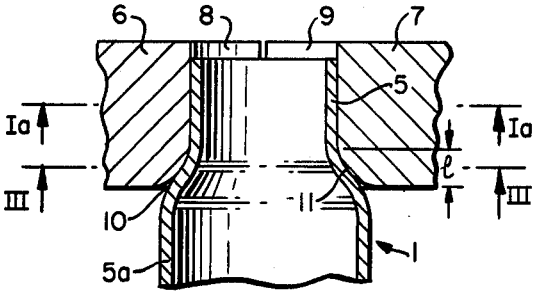
FIG. 2 is a sectional view along line II—II of FIG. 1*a;*

The length l (FIG. 2) over which the tube obtained changes progressively from an oblong cross-section to a circular cross-section can be sufficiently short, less than 0.2 times the main axis of oblong cross-section or 0.5 times the small axis of said oblong section, so that it can be possible to make heat exchangers (FIGS. 6 and 7) by using the usual collectors formed with plates 24 having circular holes 25, without the interposition of a cross-piece between the edge or margin 34 of said collector and the last gill $20_1$ of the nest.

Reference is now being made to FIGS. 8 to 13 which relate to an alternative of the method just described with reference to FIGS. 1 to 5.

Figure 12:
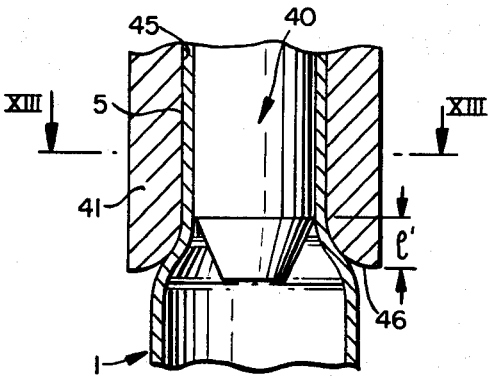
FIG. 12 is a sectional view of the tool of FIG. 8, used at the same time as a second tool for carrying out the last phase of said alternative of the method.

In this alternative, one proceeds first with an operation similar to an expansion operation, by using a tool 40 (FIG. 8) and, after this operation, one exerts a radial compression on the outer surface of the tube end with a ring 41 (FIG. 12).

Figure 9:
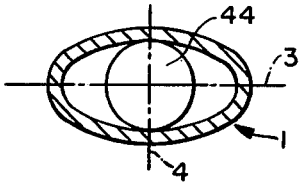
FIG. 9 shows the end of the tool of FIG. 8, driven into a tube.
Figure 13:
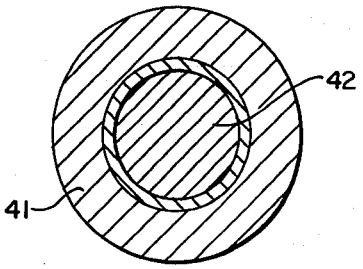
FIG. 13 is a sectional view along line XIII—XIII of FIG. 12.
Figure 10:
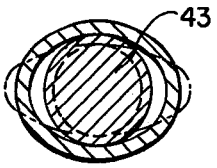
FIG. 10 is a similar view to FIG. 9, showing in cross-section the tool along line X—X of FIG. 8.

The punch 40 has a cylindrical body 42 of circular cross-section, the outer diameter of which is equal to the inner diameter desired for the end 5 of the tube, and a frustoconical end 43 the circular base 44 of which has a diameter at most equal to the smallest dimension - along axis 4 - of the inner surface of the tube in its portion of oval cross-section (FIG. 9).

The axial length l' of said portion 43 is of the same order of magnitude as the length l of the flare jaws 6 and 7 (FIG. 2), that is of the length of the intermediate portion between the tube body and the tube end after having applied the method. Thus the tubes resulting from the use of the second method allow obtaining a heat exchanger similar to that which is shown in FIGS. 6 and 7.

The punch 40 is forcibly introduced over a certain length in the end of the tube 1. Then, it is maintained in this position and a ring 41 is slidably pushed axially around the end thus conformed, the ring having a circular cylindrical inner surface 45 the inner diameter of which is equal to the outer diameter desired for the tube end. It ends at its lower portion into a chamfer or flare 46 of height l'. The outer diameter of said ring is substantially equal to the dimension of the tube 1 along its main axis 3. The chamfer 46 is formed in a similar manner as the chamfers 10 and 11 of jaws 6 and 7 of FIG. 3.

Figure 6:
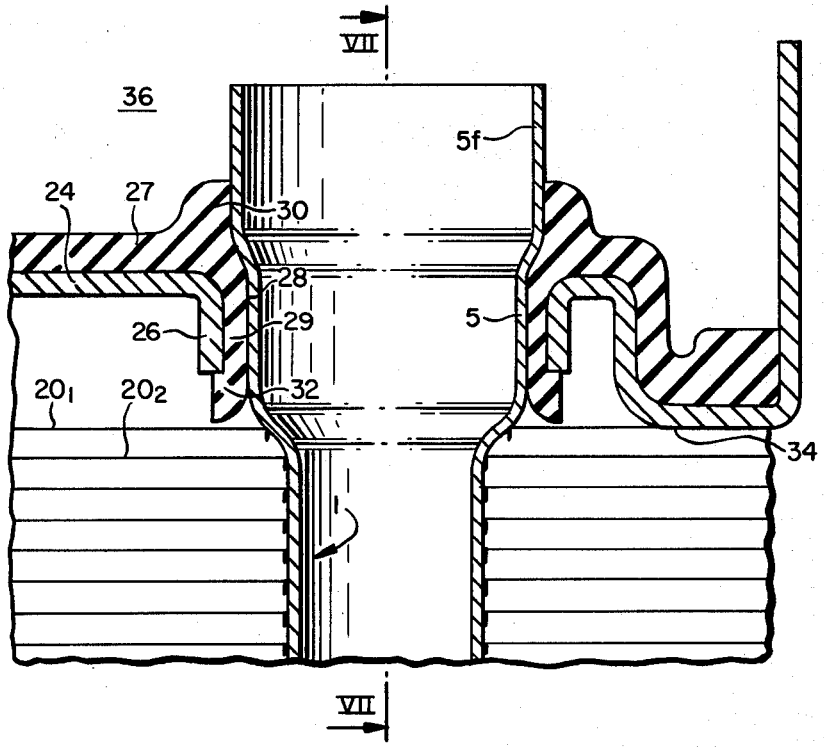
FIG. 6 is a sectional view of a portion of a heat exchanger.
Figure 7:
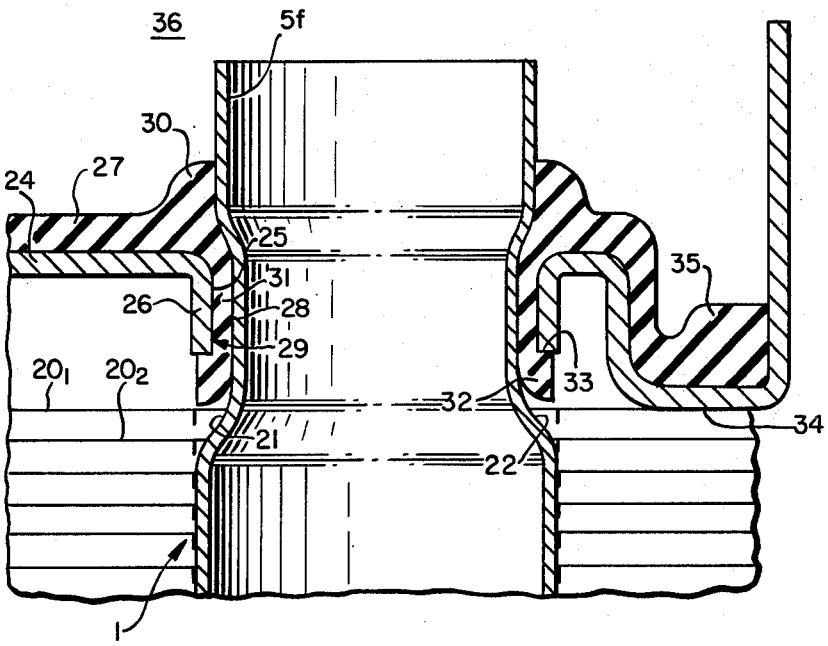
FIG. 7 is a sectional view along line VII—VII of FIG. 6.
Figure 8:
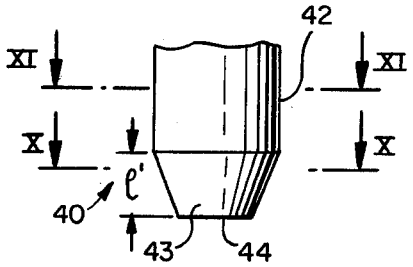
FIG. 8 shows a similar tool to that shown in FIG. 4, but for carrying out an alternative of the method.

This method allows also obtaining a heat exchanger of the type shown in FIGS. 6 and 7, that is an exchanger in which the edge of a usual collector is in direct engagement with an end gill, avoiding using a cumbrous cross-piece which is of no use for the heat exchange.

Figure 14:
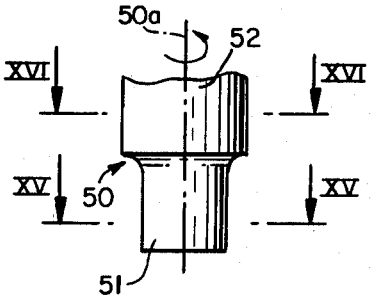
FIG. 14 is a similar view to FIG. 8, but for still another alternative tool.
Figure 11:
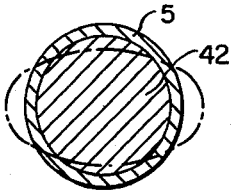
FIG. 11 is a similar view to FIG. 9, showing the tool in cross-section along line XI—XI of FIG. 8.
Figure 15:
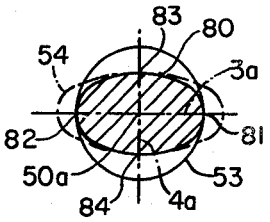
FIG. 15 is a sectional view along line XV—XV of FIG. 14.
Figure 16:
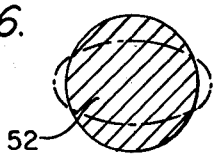
FIG. 16 is a sectional view along line XVI—XVI of FIG. 14.

Reference is now made to FIGS. 14 to 16 showing a punch 50 having a head 51 and a body 52. The head 51 has, in cross-section, the shape of an oval 80 with two vertexes 81 and 82 along its main axis 3*a*, which are diametrically opposite on a circle 53 (FIG. 15) of diameter equal to that which is desired for the inner surface of the tube end, and having two other vertexes 83 and 84 along its small axis 4*a* in coincidence with the vertexes of the oval 54 which corresponds to the inner surface of the tube body.

The body 52 is a cylinder of circular cross-section, with a diameter equal to that desired for the inner surface of the tube end.

The length of the head 51 is at least equal to the length of the end 5 of circular cross-section which it is desired to obtain.

For carrying out this alternative of the method, the head 51 of the punch 50 is introduced in the end of tube 1 in such manner that the small axis 4*a* is coincident with the small axis 4 and that the main axis 3 is coincident with the axis 3*a* over the required length for the end 5, the punch 50 being then set in rotation about its axis 50*a*, the tube being stationary, thereby allowing imparting to the tube end a shape which is close to that of a cylinder of circular cross-section. Once the rotation is stopped, the punch is again placed in the angular position which is shown in FIG. 15 and is pushed so that its body 52 finishes conforming the tube end, the head 51 having then no conformation action on the tube body inside which is is housed, but a guiding action for the tool in the tube.

The outer surface of the tube end is then conformed with the ring 41 (FIGS. 12 and 13), the punch 50 remaining inside the tube during this second phase of the method.

This alternative allows also obtaining a heat exchanger of the type which is shown in FIGS. 6 and 7, that is an exchanger in which the edge of the usual collector is in direct engagement with an end gill, avoiding using a cumbrous cross-piece which is of no use for the heat exchange.

Figure 17:
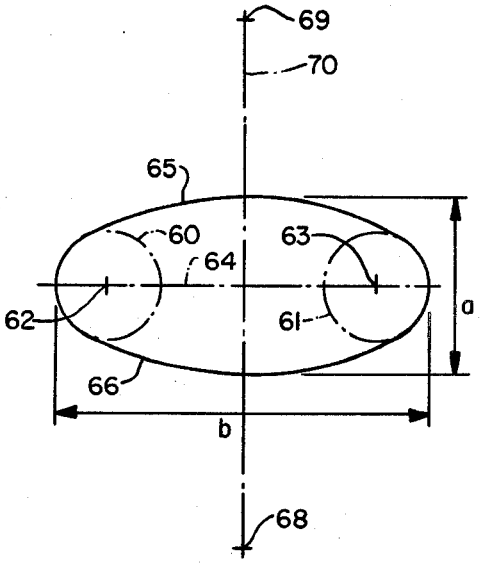
FIG. 17 is a diagrammatic view showing the cross-section of a tube favourable for practicing the invention.

In order to obtain the best results with the hereabove conformation method, the invention forsees that the tube body 1 has an oval cross-section which can be defined as follows, with reference to FIG. 17.

One traces two circles 60 and 61 of same radius with centres 62 and 63 at a distance from each other on a line 64 which will be according to the larger dimension of the cross-section of the body of tube 1; the distance between these centres is substantially superior to the diameter of each of the circles 60 and 61. Then, one traces two arcs of a circle 65, 66, tangentially to circles 60, 61, on either side of line 64, their centres 68, 69 being on the mid-perpendicular 70 of the segment connecting points 62 and 63 and being symmetrical relative to said segment; the radii of said circles being notably superior to the radii of circles 60 and 61.

The main axis of length b of the curve thus obtained and the small perpendicular axis of length a have a ratio b/a between 1.5 and 2.5 so that the heat exchange between the liquid flowing through a tube 1 and the air sweeping across the tube, preferably parallel to line 64, is optimum.

The hereabove described two step method, for several embodiments, is carried out advantageously on the ends of all the tubes of a heat exchanger on which are mounted gills, before the assembly of the collector with the rubber plate or similar covering it, and of the water box.

The holes 25 of the collector 24 are bordered, outside the collecting chamber 36, by cylindrical flanges 26 (FIGS. 6 and 7). The collector or hollowed plate 24 is coated inside chamber 36 with a sheet 27 of rubber or similar, formed with holes 28 in register with the holes 25 and bordered by sleeves 29 which are integral with said sheet 27 and comprise a portion 30 of short length and protruding towards the chamber 36 and a portion 31 of greater length introduced into the flanges 26 and ending into a bead 32 providing, at its connection with portion 31, an edge 33 bearing against the end edge of the flange 26.

The margin 34 of the metallic plate 24, protruding towards the inside of the collecting chamber, forms the bottom of a groove in which is housed a margin 35 of the rubber sheet 27.

For fixing the collectors 24 with their rubber sheet 27 at the ends of the tubes, the sleeves 29 are pre-stressed, the diameter of their inner surface in their free state being less than the diameter of the outer surface of the tube ends, and the tube ends are passed through the collectors until, on each side, the edges 34 are in engagement with an end gill $\mathbf{20}_1$. The pre-stress is then removed, and then punches or mandrels (not shown) are introduced simultaneously into the ends of the tubes so as to carry out a new expansion operation so as to form the end 5 with a flare 5*f* the outer diameter of which is slightly more than the inner diameter of the flange 26 so as to keep the collector 24 assembled relative to the tubes 1. The engagement between the edge 34 and the end gill $\mathbf{20}_1$ contributes also to said assembly.

Of course, the methods according to the invention can also be used in the case where the tightness of each of the tube ends at the level of the collector is provided not by a single seal but by a plurality of seals.

The described method is also applicable to the case where the introduction of the tubes in the seal or seals at the level of the collector is effected by forcing them in.

The conformation of the end of the tubes of oblong cross-section according to the invention allows also ensuring the tightness at the level of the collector when no seals are used, that is when the end of the tubes is in direct engagement with the metal of the hollowed plate.

The fact that one obtains a circular shape sufficiently accurate by using the methods hereabove described also allows making easier the connection by soldering or screwing of the end of each of the tubes to other tubes, having also a circular cross-section, as is the case, for example, with evaporators.

What is claimed is:

1. A method for forming the end of a metallic tube of oblong cross-section to a circular cross-section adapted for use in a vehicular heat exchanger comprising the two steps of:

(a) firstly, radially compressing the end of the tube; and (b) thereafter, driving a punch into the end of the tube, the punch diameter being equal to that desired for the inner surface of the tube end after forming, being longer than the smallest dimension of the oblong cross-section of the tube and being smaller than the largest dimension of the oblong cross-section of the tube.

2. A method according to claim 1, wherein the first radial compression step is carried out on the outer surface at the ends of the larger dimension of the oblong section of the tube.

3. A method according to claim 2, wherein the first radial compression step is carried out by using two jaws formed with semi-cylindrical recesses of same circular cross-section and of diameter slightly greater than that desired for the outer surface of the end of the tube.

4. A method for forming the end of a metallic tube of oblong cross-section to a circular cross-section adapted for use in a vehicular heat exchanger comprising the two steps of:

(a) firstly, driving a punch into the end of the tube, the punch diameter being equal to that desired for the inner surface of the tube end after forming, being longer than the smallest dimension of the oblong cross-section of the tube and being smaller than the largest dimension of the oblong cross-section of the tube; and (b) thereafter, radially compressing the end of the tube.

5. A method according to claim 4, wherein the subsequent radial compression step is carrier out uniformly around the tube.

6. A method according to claim 5, wherein the radial compression step is carried out by sliding a ring having an inner cylindrical surface of circular cross-section over the tube end, the diameter of said inner cylindrical surface being equal to that desired for the outer surface of the tube end.

7. A method according to claim 6, wherein the punch remains in the tube during the displacement of the ring for effecting the radial compression step.

8. A method according to claim 4, wherein the punch has a head of oblong cross-section, the transverse larger dimension of which is equal to the diameter desired for the inner surface of the end of the tube and the smaller dimension of which is at most equal to the smallest dimension of the tube of oblong cross-section so that the head of the punch may drive into the tube without deforming it, and a cylindrical body of circular cross-section, with a diameter equal to that desired for the inner surface of the tube end, said punch being first introduced into the end of the tube so as not to deform it, then set in rotation about its longitudinal axis so that the shape of the end of the tube comes close to that of a circular ring, the body of said punch being then - after stopping the rotation in an angular position of the oblong head such that said head does not deform the body of the tube - forcibly driven into the end of the tube.

9. A method according to claim 1, 2, 3, 5, 6, 7, 8 or 4, wherein the intermediate portion which separates the tube body from its end extends over a length at most equal to 0.2 times the larger dimension of the oblong section of the tube, or 0.5 times the smallest dimension of said oblong section.

10. A method according to claim 1, 2, 3, 5, 6, 7, 8 or 4, for manufacturing a heat exchanger in which the ends of the tube extend tightly through a collector formed by a plate with circular holes, wherein after the manufacture of the ends of circular cross-section and the assembly of the collector on the tubes, the ends of the tubes are again subejcted to an expansion operation for increasing their diameter so as to prevent an axial displacement of the tube relative to the collector.

11. A method according to claim 1, 2, 3, 5, 6, 7, 8 or 4, wherein the mean perimeter of the circular section of the tube end is greater by at least 1% with respect to the mean perimeter of the oblong section of the tube body.

12. A method according to claim 11, wherein the diameter of the outer surface of the tube end is smaller than the larger transverse dimension of the outer surface of the tube body.

* * * * *